US007371958B2

(12) United States Patent
Kim et al.

(10) Patent No.: US 7,371,958 B2
(45) Date of Patent: May 13, 2008

(54) METHOD, MEDIUM, AND SYSTEM SUMMARIZING MUSIC CONTENT

(75) Inventors: Hyoung Gook Kim, Yongin-si (KR); Ji Yeun Kim, Seoul (KR); Ki Wan Eom, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 11/521,320

(22) Filed: Sep. 15, 2006

(65) Prior Publication Data

US 2007/0113724 A1 May 24, 2007

(30) Foreign Application Priority Data

Nov. 24, 2005 (KR) ..... 10-2005-0112763

(51) Int. Cl.
*A63H 5/00* (2006.01)
*G04B 13/00* (2006.01)
*G10H 7/00* (2006.01)

(52) U.S. Cl. ..... 84/609

(58) Field of Classification Search ..... 84/609; 700/94

See application file for complete search history.

(56) References Cited

U.S. PATENT DOCUMENTS 6,225,546 B1 * 5/2001 Kraft et al. ..... 84/609
6,555,738 B2 * 4/2003 Hughes et al. ..... 84/609
6,633,845 B1 * 10/2003 Logan et al. ..... 704/255
6,881,889 B2 * 4/2005 Lu et al. ..... 84/616
6,998,527 B2 * 2/2006 Agnihotri ..... 84/609
2004/0028281 A1 * 2/2004 Cheng et al. ..... 382/232
2004/0064209 A1 * 4/2004 Zhang ..... 700/94
2005/0065976 A1 * 3/2005 Holm et al. ..... 707/104.1
2005/0091062 A1 * 4/2005 Burges et al. ..... 704/273
2006/0065102 A1 * 3/2006 Xu ..... 84/600

FOREIGN PATENT DOCUMENTS

JP 10-039890 2/1998
JP 2002-014691 1/2002
JP 2004-205575 7/2004
KR 10-2005-0084039 8/2005
WO WO 2004/090752 A1 10/2004

* cited by examiner

*Primary Examiner*—Jeffrey Donels
(74) *Attorney, Agent, or Firm*—Staas & Halsey LLP

(57) ABSTRACT

Embodiments of the present invention relate to a method, medium, and system for summarizing music. The method includes summarizing a music content by extracting an audio feature value from a compressed segment of music data, tracking change points of the music content using the extracted audio feature value and re-configuring segments, selecting a fixed length fragment from each of the reconfigured segments and clustering the selected fragment so as to measure similarity and redundancy between the respective segments, and generating a summary of the music content using a segment selected based on the measured similarity and redundancy between the respective segments.

17 Claims, 6 Drawing Sheets

CUTTING{{A,K}, {C,G}, {D,H}, {E,J}, {F,I}}

METHOD, MEDIUM, AND SYSTEM SUMMARIZING MUSIC CONTENT

CROSS-REFERENCE TO RELATED APPLICATIONS

This application claims the benefit of Korean Patent Application No. 10-2005-112763, filed on Nov. 24, 2005, in the Korean Intellectual Property Office, the disclosure of which is incorporated herein by reference.

BACKGROUND OF THE INVENTION

1. Field of the Invention

Embodiments of the present invention relate to a method, medium, and system summarizing the content of music ("music content"), e.g., in a digital contents management system, and more particularly to a method, medium, and system summarizing a music content in which an audio feature value has been extracted from a compressed area of music data, change points of the music content are tracked by using the extracted audio feature value to re-configure segments, a fixed length fragment is selected from each of the reconfigured segments and the selected fragment is clustered so as to measure similarity and redundancy between the respective segments, and a summary of the music content is generated by using a segment selected based on the measured similarity and redundancy between the respective segments 2. Description of the Related Art In general, digital contents management systems have included summarizing aspects, summarizing a music content in order to rapidly search for a piece of music similar to a music file that a user selects from a large-capacity music database.

As an example of a conventional music summarization technique, U.S. Pat. No. 6,633,845 discusses a cross-entropy measure or a Hidden Markov Model (HMM) approach to identify the structure of a song by using feature vector values of Mel-Frequency Cepstral Coefficients (MFCCs) extracted from an uncompressed segment of each audio file. However, such a conventional music summarization technique includes problems, in that it may be suitable for a summarization of a distinct music genre such as rock or folk, but not that of classical music.

As another example, US patent application Serial No. 2005/0065976 discusses the structure of a song being identified by using a 2-D similarity matrix appended to feature vector values of Mel-Frequency Cepstral Coefficients (MFCCs) extracted from an uncompressed segment of each audio file, and then a summary of the song being generated from the identified song structure. However, such a technique does not provide a summary of the song perceptually.

Further, another example includes extracting a dynamic feature according to a variation in energy acquired in a variety of frequency bands of a music signal as an audio feature value. Also, in this technique, large and rapid change portions are located using a similarity matrix between respective feature frames to obtain corresponding segments. Then, an average value of the features within the obtained segments is obtained. At this time, the obtained average value is defined as a potential state. Using the potential state, redundancy of the average value between respective segments is identified. Then, similarity between segments is assumed based on the identified redundancy of the average value and is incorporated into one segment. Such a technique incorporates segments so that after the number of potential states and an initial state have been defined, a state defined by a K-means algorithm is employed as an initialization of a Hidden Markov Model (HMM) training. That is, such a technique establishes a model using a Baum-Welch algorithm of the Hidden Markov Model (HMM), decodes a music audio file using the established model, and produces a summary of music content using a short segment from segments acquired in the decoding process. However, this technique similarly has shortcomings in that since it is configured in a multi-pass manner, a greater number of calculations are required, resulting in the processing speeds being slow.

As such, here, this conventional technique encounters problems in that it obtains a number of classes using segments acquired by segmentation, establishes each class model using a K-means algorithm and a HMM accordingly, and then decodes a music audio signal, thereby increasing the number of calculations and reducing the process speed.

Thus, for such music summarization techniques, the music audio signal is divided into short segments and then well-known audio feature values such as Mel-Frequency Cepstral Coefficients (MFCC), Linear Predictive Coding (LPC), Zero Crossing Rates (ZCR), etc., are extracted. However, these music summarization methods further have problems in that when similarity is measured using a distance and then a clustering is performed, so as to measure a similarity of the short segments, these techniques result in the generation of a clustering error.

SUMMARY OF THE INVENTION

Accordingly, considering the aforementioned problems, it is an aspect of an embodiment of the present invention to provide a method, medium, and system for summarizing a music content, where an audio feature value is extracted from an uncompressed segment of a music data so as to generate a summary of a music content at a high rate.

Another aspect of an embodiment of the present invention includes a method, medium, and system for summarizing a music content, where change points of the music content are tracked more distinctly by using a strong peak algorithm.

Still another aspect of an embodiment of the present invention includes a method, medium, and system for summarizing a music content, where segments according to a change point of music content are applied to a clustering process to thereby reduce complexity of the clustering process.

Yet still another aspect of an embodiment of the present invention includes a method, medium, and system for summarizing a music content, where a fixed length segment is selected from segments formed according to a change point of music content to perform a clustering process and thereby increase the accuracy of the clustering.

Additional aspects and/or advantages of the invention will be set forth in part in the description which follows and, in part, will be apparent from the description, or may be learned by practice of the invention.

To achieve the above and/or other aspects and advantages, embodiments of the present invention include a method for summarizing a music content, including extracting an audio feature value from a compressed segment of music data, from a plurality compressed segments of the music data, tracking change points of a music content of the music data using the extracted audio feature value and re-configuring the segments of the music data, selecting a fixed length fragment from each of the reconfigured segments and clustering the selected fragments so as to measure similarity and redundancy between respective segments, and generating a summary of the music content using a segment selected based on the measured similarity and redundancy between the respective segments.

The extracting of the audio feature value may include performing a partial decoding process of the compressed segment of the music data so as to extract a modified discrete cosine transformation (MDCT) feature value.

In addition, the tracking of change points of the music content may include setting two fixed length segments based on an extracted MDCT feature value, as the extracted audio feature value, and determining a similarity between the set two fixed length segments while shifting the fixed length two segments at certain time intervals along the music data so as to track the change points of the music content.

The determining of the similarity between the set two fixed length segments may include calculating a plurality of peaks by using a Modified Kullback-Leibler Distance (MKL) operation, comparing more than N peaks from among the calculated plurality of peaks and sorting compared peaks along categories of a high peak, a low peak and an intermediate peak, determining high peaks as satisfying a predefined inclined section as a plurality of candidate music change peaks, and determining the candidate music change peaks, among the plurality of candidate music change peaks, positioned over a threshold as the change points of the music content.

Here, the threshold may be automatically generated by a mean value for over five peaks calculated by the MKL method.

In addition, the selecting of the fixed length fragments may include selecting the fixed length fragments from each segment by detecting change points of the music content to measure similarity and redundancy between the respective segments by a Bayesian Information Criterion (BIC) method.

The selecting of the fixed length fragments may further include extracting MDCT-based timbre and tempo features from respective compressed segments, re-configured according to the change points of the music content, combining the extracted timbre and tempo features with each other and clustering the segments based on a Euclidean distance clustering operation to measure similarity and redundancy between the segments, and determining similarity and redundancy between the respective segments according to a compared result between a segment clustering result obtained by the BIC operation and a segment clustering result obtained by the Euclidean distance clustering operation.

Here, the determining of the similarity and redundancy between the respective segments may include deciding the similarity and redundancy of the respective segments based on the Euclidean distance clustering operation if there is no matching portion for the result of the segment clustering result by the BIC method and the result of the segment clustering by the Euclidean distance clustering operation.

Further, the generating of the summary of the music content may include determining segment pairs depending on the measured similarity between the respective segments, selecting first segments of the determined segment pairs as to-be-summarized targets, and generating the summary of the music content as having a certain time length while taking into consideration a ratio of the selected respective segments.

The generating of the summary of the music content may include generating the summary of the music content to have a certain time length while taking into consideration the ratio of the selected respective segments based on a longest segment among the selected respective segments.

In addition, the method may include playing back the longest segment as a highlighted portion of the music data upon request by a user for a representative summary of the music content.

To achieve the above and/or other aspects and advantages, embodiments of the present invention include at least one medium including computer readable code to implement embodiments of the present invention.

To achieve the above and/or other aspects and advantages, embodiments of the present invention include a system to summarize a music content, including a feature extractor to extract an audio feature value from a compressed segment of music data, from a plurality compressed segments of the music data, a music content change detector to track change points of a music content of the music data using the extracted audio feature value and to re-configure the segments of the music data, a clustering unit to select a fixed length fragment from each of the reconfigured segments and to cluster the selected fragments so as to measure similarity and redundancy between respective segments, and a music content summary generator to generate a summary of the music content using a segment selected based on the measured similarity and redundancy between the respective segments.

The feature extractor may perform a partial decoding process of the compressed segment of the music data so as to extract a modified discrete cosine transformation (MDCT) feature value.

In addition, the music content change detector may set two fixed length segments based on an extracted MDCT feature value, as the extracted audio feature value, and determine a similarity between the set two fixed length segments while shifting the two fixed length segments at certain time intervals along the music data so as to detect the change points of the music content.

The clustering unit may further include a first clustering unit to select the fixed length fragments from each segment by the detected change points of the music content and to perform a clustering for the selected fixed length fragments so as to measure similarity and redundancy between the respective segments by way of a Bayesian Information Criterion (BIC) operation, a timbre and tempo feature extractor to extract MDCT-based timbre and tempo features from respective compressed segments so as to analyze corresponding music content in each segment, re-configured according to the change points of the music content, a second clustering unit to calculate a Euclidean distance from the respective extracted timbre and tempo features to measure similarity and redundancy between the respective segments, and a decision unit to determine the similarity and redundancy between the respective segments by using a matching portion of a comparing of a result of the first clustering unit with a result of the second clustering unit, and determining a representative portion of the music data.

Further, the music content summary generator may determine segment pairs depending on the measured similarity between the respective segments, select first segments of the determined segment pairs as to-be-summarized targets, and generate the summary of the music content as having a constant time length while taking into consideration a ratio of the selected respective segments.

BRIEF DESCRIPTION OF THE DRAWINGS

The above and/or other aspects and advantages of the present invention will become apparent and more readily appreciated from the following detailed description, taken in conjunction with the accompanying drawings of which.

DETAILED DESCRIPTION OF THE PREFERRED EMBODIMENTS

Figure 1:
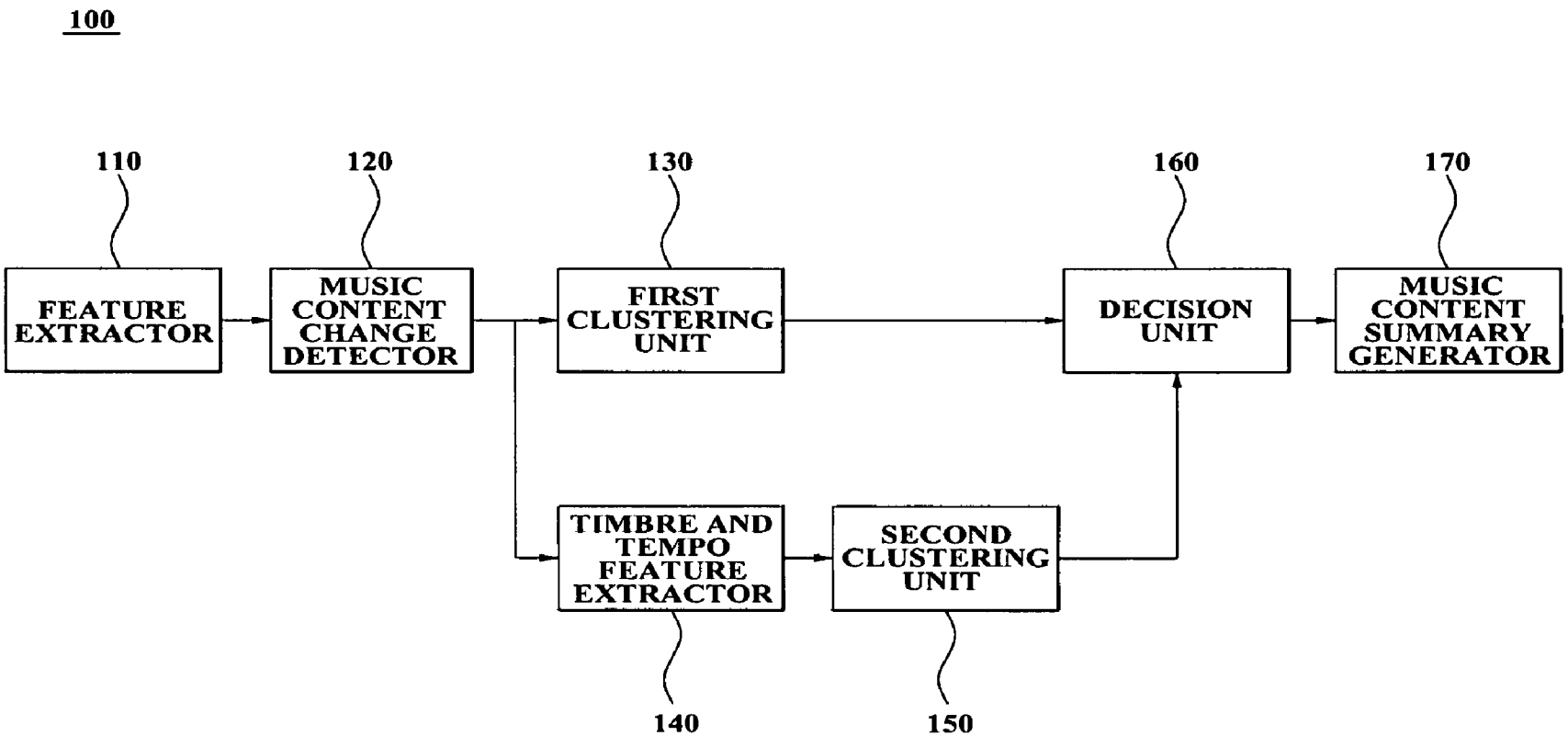
FIG. 1 illustrates a system for summarizing a music content, according to an embodiment of the present invention.

Reference will now be made in detail to embodiments of the present invention, examples of which are illustrated in the accompanying drawings, wherein like reference numerals refer to the like elements throughout. Embodiments are described below in order to explain the present invention by referring to the figures.

FIG. 1 illustrates a system for summarizing a music content, according to an embodiment of the present invention.

Referring to FIG. 1, the system 100 for summarizing a music content may include a feature extractor 110, music content change detector 120, a first clustering unit 130, a timbre and tempo feature extractor 140, a second clustering unit 150, a decision unit 160, and a music content summary generator 170, for example.

The feature extractor 110 may serve to extract an audio feature value from a compressed segment of music data. The feature extractor 110 may further perform a partial decoding process in the compressed segment of the music data so as to extract a modified discrete cosine transformation (MDCT) feature value. According to one embodiment, the MDCT feature value may include a timbre feature value and a tempo feature value, for example.

Here, the feature extractor 110 may partially decode a music file compressed in a predetermined compression method to extract 576 MDCT coefficients $S_i(n)$, for example. Here, n denotes a frame index of MDCT, and i (0 to 575) denotes a sub-band index of MDCT. Next, the feature extractor 110 divides 576 MDCT coefficients by 30 sub-bands ($S_k(n)$), for example, and extracts energy from each sub-band. Here, $S_k(n)$ denotes the selected MDCT coefficient, and k(<i) denotes a sub-band index of the selected MDCT.

As such, the music content summarizing system 100, according to an embodiment of the present invention, permits the feature extractor 110 to extract an audio feature value from the compressed segment of the music data so that a processing speed needed for summarizing the music can be improved, as compared to the aforementioned conventional systems that summarize the music contents from uncompressed segments.

The music content change detector 120 may detect change points of the music content in the music data using the extracted audio feature value and then re-configures segments, for example.

According to an embodiment, the music content change detector 120 sets two fixed length segments based on the extracted audio feature value, and calculates a similarity between two adjacent segments while overlapping them so as to track the change points of the music content and to re-configure the segments.

Figure 4:
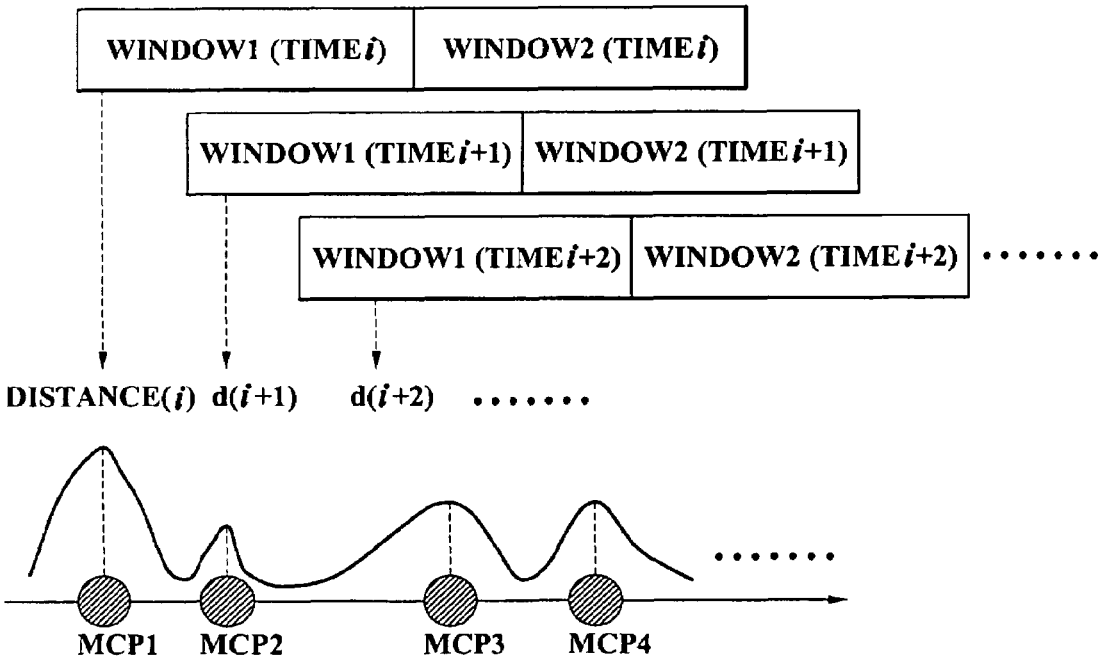
FIG. 4 illustrates an example of a tracking of change points of a music content, according to an embodiment of the present invention.

Thus, as illustrated in an example of an operation of the music content change detector 120, as shown in FIG. 4, segments may be set using two windows of a fixed length, e.g., based on the extracted MDCT energy coefficients, and a similarity between the two segments may be determined while shifting the two windows at certain time intervals along the music data so as to detect the change points of the music content.

The first clustering unit 130 may further select a fixed length fragment from each segment, acquired by the detected change points of the music content, and perform a clustering for the selected length fragment of each segment so as to measure similarity and redundancy between the respective segments by way of a Bayesian Information Criterion (BIC) method, for example.

As such, the music content summarizing system 100, according to an embodiment of the present invention, may detect change points of the music content and then cluster each segment configured according to the detected change points of the music content to measure similarity and redundancy between the respective segments and so as to eliminate a clustering error of an existing short segment.

The timbre and tempo feature extractor 140 may further extract MDCT-based timbre and tempo features so as to analyze the corresponding music content in each segment acquired by the detected change points of the music content.

The timbre and tempo feature extractor 140 may typically obtain centroid, bandwidth, flux, and flatness of the spectrum from two kinds of features, for example, so as to combine the extracted timbre and tempo features with each other.

$$C(n) = \frac{\sum_{i=0}^{k-1} (k+1) s_i(n)}{\sum_{i=0}^{k-1} s_i(n)} \qquad \text{Equation 1}$$

Equation 1 is an expression associated with the centroid of the spectrum.

The centroid of the spectrum indicates the characteristics of the strongest beat rate.

$$B(n) = \sqrt{\frac{\sum_{i=0}^{k-1} [i + 1 - C(n)]^2 \times S_i(n)^2}{\sum_{i=0}^{k-1} S_i(n)^2}} \; j \qquad \text{Equation 2}$$

Equation 2 is an expression associated with the bandwidth of the spectrum.

The bandwidth denotes the range characteristics of the beat rate.

$$F(n) = \sum_{i=0}^{k-1} (s_i(n) - s_i(n-1))^2 \qquad \text{Equation 3}$$

Equation 3 is an expression associated with the flux of the spectrum.

The flux of the spectrum denotes the change characteristics of the beat rate depending on time.

The flatness of the spectrum indicates which characteristics have a definite and strong beat.

The second clustering unit 150 may further calculate a Euclidean distance from the timbre and tempo features extracted from each segment to measure similarity and redundancy between the respective segments, and apply the measured similarity to the clustering.

As such, the music content summarizing system 100, according to an embodiment of the present invention, may combine the timbre and tempo features extracted from the compressed segment of each segment configured according to the change points of the music content detected to increase matching accuracy, to thereby apply the combining result to the clustering process.

The second clustering unit 150 may determine a largest cluster, for example, obtained through the clustering process, as a representative candidate of the music data.

The decision unit 160 may compare the first clustering result, e.g., obtained by the first clustering unit 130, with the second clustering result, e.g., obtained by the second clustering unit 150, and determine a representative portion of the music data, and the similarity and redundancy between the respective segments by using a matching portion for the compared result.

Here, the decision unit 160 may decide the similarity and redundancy of the respective segments based on the second clustering result if there is not a matching portion for the comparison result of the first clustering result and the second clustering result, for example.

As such, in the music content summarizing system 100, according to an embodiment of the present invention, a summary of the music content generated by using only the clustering result, based on the BIC method by the first clustering unit 130, is well suited for a music content with a simple structure, but it may be difficult to generate a summary of the music content for a variety of music genres. Accordingly, in order to address and solve this potential, the music content summarizing system 100 may further include the timbre and tempo feature extractor 140, the second clustering unit 150, and the decision unit 160, for example.

Therefore, here, the music content summarizing system 100 may generate a summary of the music content with high speed by selecting a fixed length fragment from each segment, configured according to the change points of the music content and using the timbre and tempo features extracted from the compressed segment of the segment based on a combination of the BIC method and the Euclidean distance clustering method, for example.

According to an embodiment of the present invention, the music content summary generator 170 may generate a summary of the music content by using a segment selected based on the measured similarity and redundancy between the respective segments, for example.

Here, the music content summary generator 170 may determine segment pairs based on the measured similarity, select first segments of the decided segment pairs as to-be-summarized targets, and generate a summary of the music content having a constant time length while taking into consideration the ratio of the selected respective segments.

The music content summary generator 170 may further generate a summary of the music content having a time length of 50 seconds, as only example, from three-minute music data, also as an example, while taking into consideration the ratio of the selected segments based on the longest segment among the selected respective segments.

Accordingly, according to an embodiment, the music content summarizing system 100 may allow a user to hear a portion of a longest segment through the summary of the music content while playing back such a longest segment as a selected portion of music data when he or she wants to listen to music.

Figure 2:
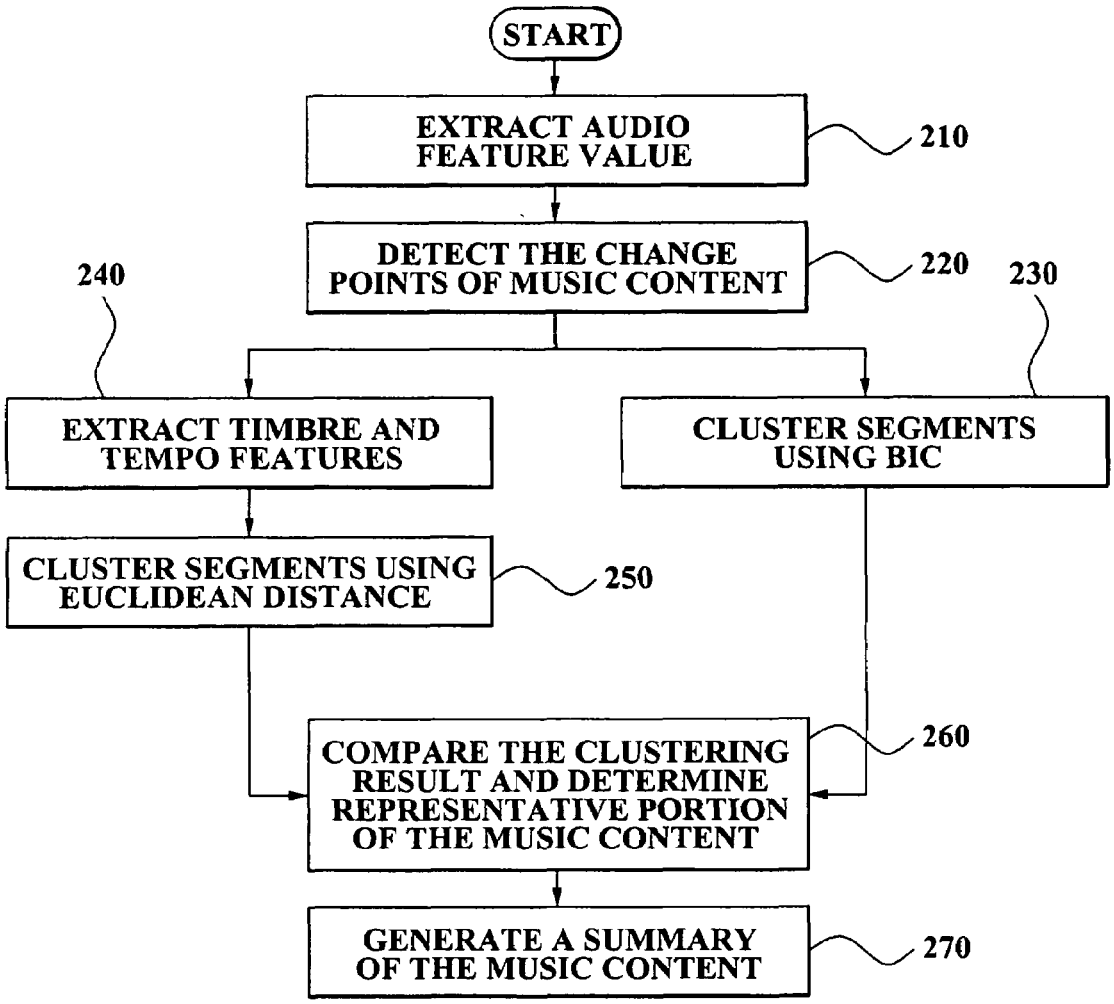
FIG. 2 illustrates a process for summarizing a music content, according to an embodiment of the present invention.

FIG. 2 illustrates a process for summarizing a music content, according to an embodiment of the present invention.

Referring to FIG. 2, in operation 210, the music content summarizing system 100, for example, may extract an audio feature value from a compressed segment of music data.

In operation 210, a partial decoding process may be performed in the compressed segment of the music data so as to extract a modified discrete cosine transformation (MDCT) feature value. Such a detailed description of an extraction of the MDCT feature value will be omitted here since a similar process has been described above with reference to the feature extractor 110.

As such, the music content summarizing method, according to an embodiment of present invention, has an advantage in that an audio feature value may be extracted from a compressed segment of music data, thereby greatly improving processing speed compared to conventional extraction techniques that required an audio feature value to be obtained from an uncompressed segment of music data.

In operation 220, change points of the music content may be tracked by using the extracted audio feature value to re-configure segments.

Figure 3:
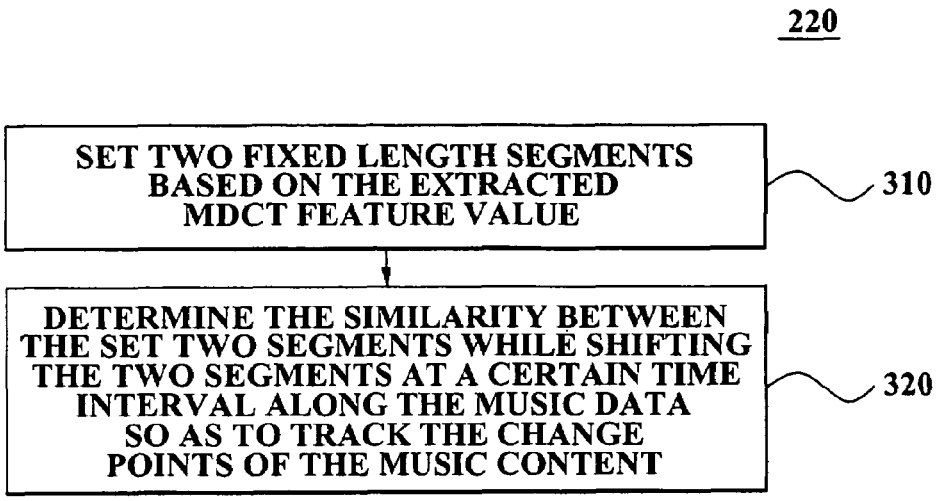
FIG. 3 illustrates a tracking of change points of a music content and a re-configuring of segments, according to an embodiment of the present invention.

That is, in operation 220, as shown in FIG. 3, change points of the music content may be tracked to re-configure the segments.

FIG. 3 illustrates the tracking of change points of the music content and re-configuring segments, according to an embodiment of the present invention.

Referring to FIG. 3, in operation 310, two fixed length segments may be set based on the extracted MDCT feature value.

In operation 320, the similarity between the set two segments Window1 and Window2 may be determined while shifting the two segments at certain time intervals along the music data, as shown in FIG. 4, so as to track the change points MCP1, MCP2, MCP3 and MCP4 of the music content, for example.

Further, in operation 320, two segments having a fixed length of, for example, more than three seconds may be set, and then the similarity between the set two segments may be determined while shifting the two segments at time intervals of less than 1.5 seconds, also as only an example, along an entire music signal.

Figure 5:
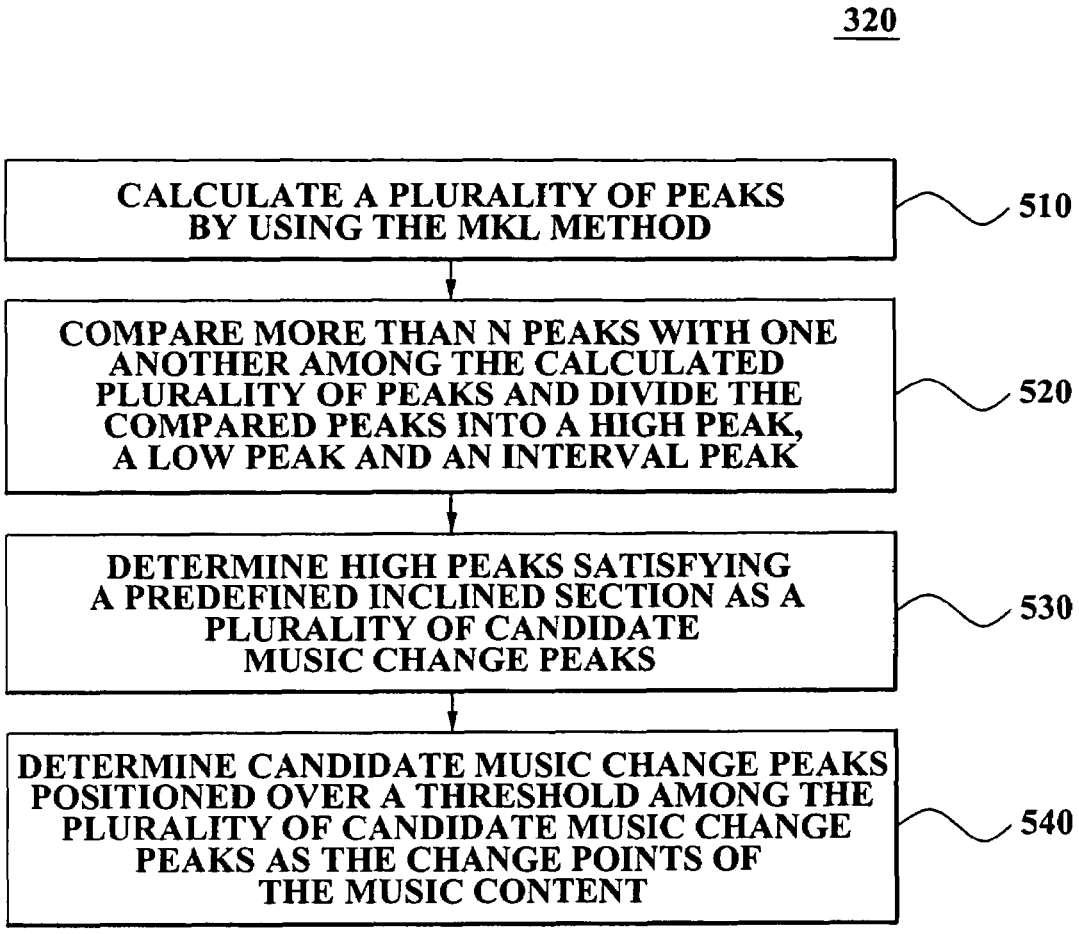
FIG. 5 illustrates a tracking of change points of a music content, according to an embodiment of the present invention.

In operation 320, a Modified Kullback-Leibler Distance (MKL) method may be employed to determine whether there is similarity between the two segments, and can be used to track the change points of the music content, e.g., according to a procedure shown in FIG. 5.

In this embodiment, FIG. 5 illustrates an example of a tracking of change points of the music content.

Referring to FIG. 5, in operation 510, a plurality of peaks may be calculated by using the MKL method.

$$d_{MKL} = \frac{1}{2} tr\left[\left(\sum_{l} - \sum_{r}\right)\left(\sum_{l}^{-1} - \sum_{r}^{-1}\right)\right] \quad \text{Equation 4}$$

Here, Σ corresponds to the covariance; l corresponds to the left segment of two segments; and r corresponds to the right segment of two segments.

Such a music content summarizing method, according to an embodiment of the present invention, may encounter a problem when the MKL method is used, in that peaks at various intervals and heights appear, resulting in it being difficult to determine which peak is a peak for determining the change points of the music content.

Accordingly, in operation 520, more than N peaks may be compared, among the calculated plurality of peaks, and the compared peaks may be sorted into high peaks, low peaks and intermediate peaks.

Figure 6:
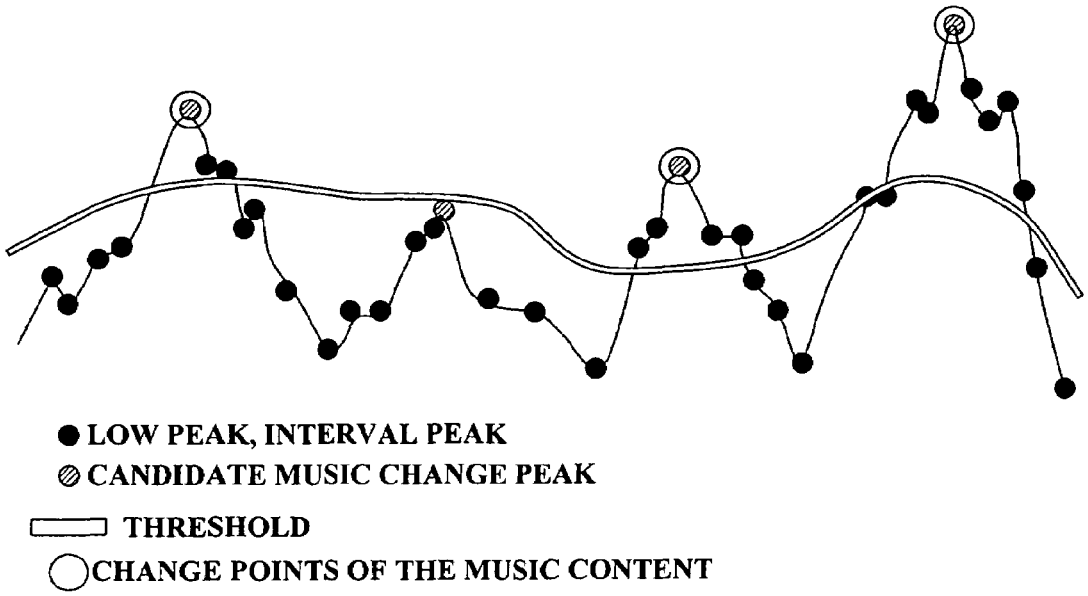
FIG. 6 illustrates an example of a detecting of change points of a music content, among change peaks of a candidate music, according to an embodiment of the present invention.

In operation 530, a high peak which satisfies a predefined inclined section may be chosen from one of a plurality of candidate music change peaks, as shown in FIG. 6. The predefined inclined section may require that a high peak should be higher than a previous peak and be higher than the next five peaks, for example, according to an embodiment of the present invention.

In operation 540, candidate music change peaks positioned over a threshold, among the plurality of candidate music change peaks, may be determined to be the change points of the music content. The threshold may further be generated by a mean value for over five peaks calculated by the MKL method, for example.

As such, according to an embodiment of the present invention, a music content summarizing method may utilize a strong peak search algorithm so that change points of the music content can be detected more distinctly.

in operation 230, a fixed length fragment from each of the reconfigured segments may be selected and the selected fragment may be clustered so as to measure similarity and redundancy between the respective segments.

As such, according to an embodiment of the present invention, such a method has an advantage in that since a segment according to the change points of the music content is used for a clustering process, the complexity of the clustering process may be reduced over conventional techniques.

In addition, according to an embodiment of the present invention, another advantage is that since a fixed length segment may be selected from the segments formed along the change points of the music content and subjected to clustering, the accuracy of the clustering may also be increased.

Figure 7:
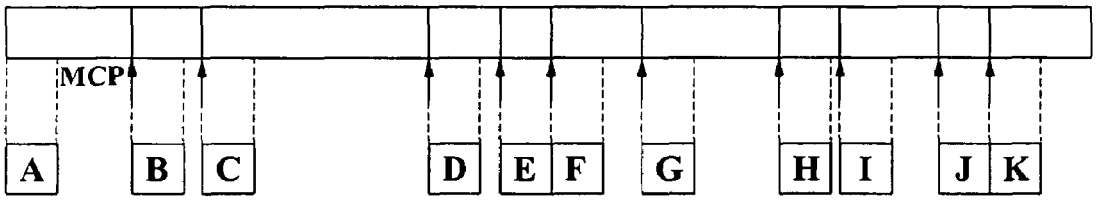
FIG. 7 illustrates an example of a selecting of a fixed length fragment from segments, according to an embodiment of the present invention.

In operation 230, a fixed length fragment may be selected, as shown in FIG. 7, from each segment acquired by the detected change points of the music content, to measure similarity and redundancy between the respective segments by the BIC method.

$$R_{BIC}(i) = \frac{N_{Total}}{2}\log\left|\sum_{Total}\right| - \frac{N_l}{2}\log\left|\sum_{l}\right| - \frac{N_r}{2}\log\left|\sum_{r}\right| \quad \text{Equation 5}$$

Here, N denotes the length of a segment.

The segments may be determined to be similar if $R_{BIC}(i)$ is greater than 0 (that is, $R_{BIC}(i)>0$), and segments are determined to not be similar if $R_{BIC}(i)$ is less than or equal to 0 (that is, $R_{BIC}(i)\leqq 0$), for example.

As such, in conventional techniques, when a covariance matrix having different distributions is obtained from segments of various lengths to thereby compare similarity between the segments, an error was generated. Accordingly, in order to address and solve this problem, in embodiments of the present invention segments having a fixed length of, for example, more than three seconds may be selected from various length segments acquired by the detected change points of the music content, and then the similarity and redundancy between the segments may be determined by way of the BIC method.

In operation 240, a centroid, bandwidth, flux, and flatness of the spectrum may be obtained from two kinds of features so as to combine the extracted two kinds of features, e.g., timbre and tempo features, with each other.

Further, in operation 250, a Euclidean distance may be calculated with respect to the extracted timbre and tempo features, and a clustering may be performed for segments depending on the similarity by the calculated result so as to measure the similarity and redundancy between the respective segments.

In operation 260, a largest cluster, obtained by the clustering of the segments using the Euclidean distance clustering method, may be determined to be a representative candidate of the music data.

In operation 260, then, according to an embodiment of the present invention, the first clustering result obtained by using the BIC method may be compared with the second clustering result obtained by using the Euclidean distance clustering method, and the similarity and redundancy between the respective segments may be determined according to the compared result.

In operation 260, the first clustering result may be compared with the second clustering result, and a representative portion of the music data and the similarity and redundancy between the respective segments may be determined using a matching portion for the compared result.

In operation 260, a representative portion of the music data, and the similarity and redundancy of the respective segments based on the second clustering result may be determined if there is no matching portion for the comparison result of the first clustering result and the second clustering result.

As such, according to an embodiment of the present invention, the music content summarizing method may include a generating of a summary of the music content with high speed by selecting a fixed length fragment from each segment configured according to the change points of the music content, using the timbre and tempo features extracted from the compressed segment of the segment based on a combination of the BIC method and the Euclidean distance clustering method.

In operation 270, a summary of the music content may thus be generated by using a segment selected based on the measured similarity and redundancy between the respective segments.

In operation 270, segment pairs may be determined based on the measured similarity, first segments of the decided segment pairs may be selected as to-be-summarized targets, and a summary of the music content having a constant time length, for example, may be generated while taking into consideration the ratio of the selected respective segments.

Figure 8:
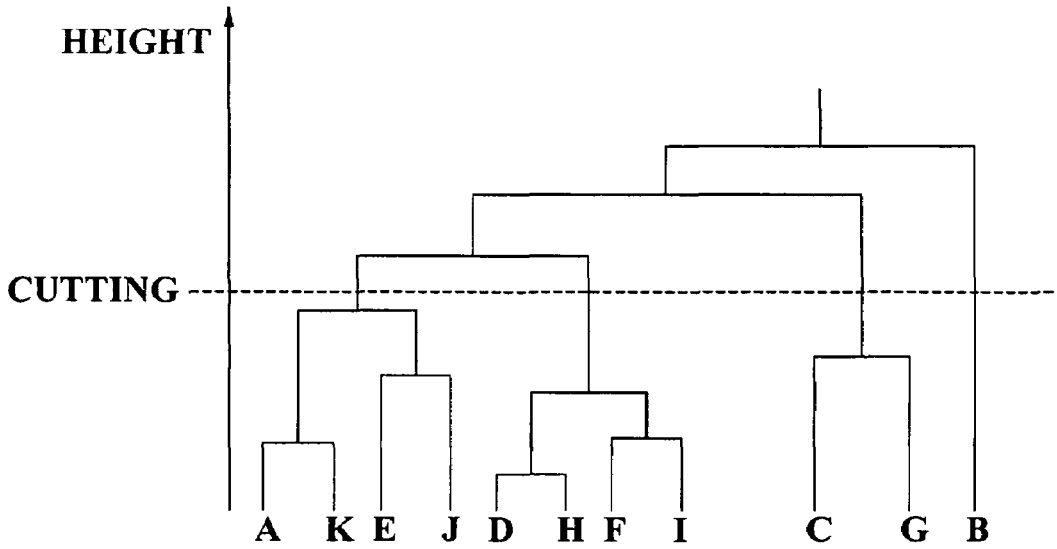
FIG. 8 illustrates an example of a clustering of segments, according to an embodiment of the present invention.

As an example, and as illustrated in FIG. 8, segment pairs {A,K}, {C,G}, {D,H}, {E,J} and {F,I} may be determined based on the measured similarity. Then, in operation 240, similarity-free segment B may be excluded according to an arrangement order of the segments, and the first segments A, C, D, E and F of the decided segment pairs {A,K}, {C,G}, {D,H}, {E,J} and {F,I} may be selected as to-be-summarized targets. Thereafter, a summary of the music content having a certain time length may be generated while taking into consideration the ratio of the selected respective first segments A, C, D, E and F.

Figure 9:
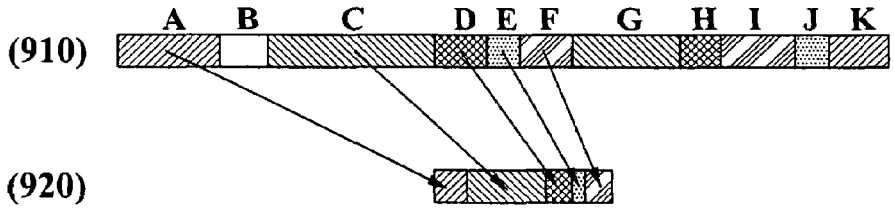
FIG. 9 illustrates an example of a generating of a summary of a music content, according to an embodiment of the present invention.

In operation 270, a summary 920 may be generated, as shown in FIG. 9, having a time length of 50 seconds, for example, of the music content with three-minute music data, for example, while taking into consideration the ratio of the selected segments based on a longest segment C, among the respective segments A, C, D, E and F selected from the music data 910.

Further, the music content summarizing system 100, and method for the same, may include playing back such a longest segment as a highlighted portion of the music data through the generated summary of the music content. For example, according to an embodiment, when a user desires to listen to music in advance before listening to the entire music file, he or she may be able to hear such a longest segment of the music data played back as a highlighted portion of the music content.

Moreover, an embodiment of the present invention provides a user with a summary of the music content having a time length of 50 seconds, or so, for three or four-minute music data so that it can be effectively utilized in a music recommendation system requiring a user's music search or the feedback of the user. Here, the selection of 50 seconds or three or four-minute music data are merely examples and embodiments of the present invention should not be limited thereto.

In addition to the above described embodiments, embodiments of the present invention can also be implemented through computer readable code/instructions in/on a medium, e.g., a computer readable medium. The medium can correspond to any medium/media permitting the storing and/or transmission of the computer readable code.

The computer readable code can be recorded/transferred on a medium in a variety of ways, with examples of the medium including magnetic storage media (e.g., ROM, floppy disks, hard disks, etc.), optical recording media (e.g., CD-ROMs, or DVDs), and storage/transmission media such as carrier waves, as well as through the Internet, for example. Here, the medium may further be a signal, such as a resultant signal or bitstream, according to embodiments of the present invention. The media may also be a distributed network, so that the computer readable code is stored/transferred and executed in a distributed fashion.

As apparent from the foregoing, according to an embodiment of a music content summarizing method, medium, and system, audio features may be extracted from a compressed segment of the music data, thereby improving the processing speed needed for summarizing the music content.

In addition, according to an embodiment of the present invention, a music content summarizing method, medium, and system may utilize a strong peak search algorithm so that the change points of the music content can be detected more accurately.

Also, according to an embodiment of the present invention, in a music content summarizing method, medium, and system, segments according to a change point of music content may be applied to a clustering process to thereby reduce complexity of the clustering process.

Further, according to an embodiment of the present invention, in a music content summarizing method, medium, and system, a fixed length segment may be selected from segments formed according to a change point of music content to perform a clustering process to thereby increase the accuracy of the clustering.

Moreover, according to an embodiment of the present invention, in a music content summarizing method, medium, and system, a summary of the music content may be generated with high speed by selecting a fixed length fragment from each segment configured according to the change points of the music content and using the timbre and tempo features extracted from the compressed segment of the segment based on a combination of the BIC method and the Euclidean distance clustering method.

Furthermore, according to an embodiment of the present invention, in a music content summarizing method, medium, and system, sorts or searches of music to provide feedback to the user can be effectively utilized in a music recommendation system.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method for summarizing a music content, comprising:

extracting an audio feature value from a compressed segment of music data, from a plurality compressed segments of the music data;

tracking change points of a music content of the music data using the extracted audio feature value and reconfiguring the segments of the music data;

selecting a fixed length fragment from each of the reconfigured segments and clustering the selected fragments so as to measure similarity and redundancy between respective segments; and generating a summary of the music content using a segment selected based on the measured similarity and redundancy between the respective segments.

2. The method of claim 1, wherein the extracting of the audio feature value comprises performing a partial decoding process of the compressed segment of the music data so as to extract a modified discrete cosine transformation (MDCT) feature value.

3. The method of claim 1, wherein the tracking of change points of the music content comprises:

setting two fixed length segments based on an extracted MDCT feature value, as the extracted audio feature value; and determining a similarity between the set two fixed length segments while shifting the fixed length two segments at certain time intervals along the music data so as to track the change points of the music content.

4. The method of claim 3, wherein the determining of the similarity between the set two fixed length segments comprises:

calculating a plurality of peaks by using a Modified Kullback-Leibler Distance (MKL) operation;

comparing more than N peaks from among the calculated plurality of peaks and sorting compared peaks along categories of a high peak, a low peak and an intermediate peak;

determining high peaks as satisfying a predefined inclined section as a plurality of candidate music change peaks; and determining the candidate music change peaks, among the plurality of candidate music change peaks, positioned over a threshold as the change points of the music content.

5. The method of claim 4, wherein the threshold is automatically generated by a mean value for over five peaks calculated by the MKL method.

6. The method of claim 1, wherein the selecting of the fixed length fragments comprises selecting the fixed length fragments from each segment by detecting change points of the music content to measure similarity and redundancy between the respective segments by a Bayesian Information Criterion (BIC) method.

7. The method of claim 6, wherein the selecting of the fixed length fragments comprises:

extracting MDCT-based timbre and tempo features from respective compressed segments, re-configured according to the change points of the music content;

combining the extracted timbre and tempo features with each other and clustering the segments based on a Euclidean distance clustering operation to measure similarity and redundancy between the segments; and determining similarity and redundancy between the respective segments according to a compared result between a segment clustering result obtained by the BIC operation and a segment clustering result obtained by the Euclidean distance clustering operation.

8. The method of claim 7, wherein the determining of the similarity and redundancy between the respective segments comprises deciding the similarity and redundancy of the respective segments based on the Euclidean distance clustering operation if there is no matching portion for the result of the segment clustering result by the BIC method and the result of the segment clustering by the Euclidean distance clustering operation.

9. The method of claim 1, wherein the generating of the summary of the music content comprises:

determining segment pairs depending on the measured similarity between the respective segments;

selecting first segments of the determined segment pairs as to-be-summarized targets; and generating the summary of the music content as having a certain time length while taking into consideration a ratio of the selected respective segments.

10. The method of claim 9, wherein the generating of the summary of the music content comprises generating the summary of the music content to have a certain time length while taking into consideration the ratio of the selected respective segments based on a longest segment among the selected respective segments.

11. The method of claim 10, further comprising playing back the longest segment as a highlighted portion of the music data upon request by a user for a representative summary of the music content.

12. At least one computer readable-medium structure comprising computer readable code to control a computer to implement the method of claim 1.

13. A system to summarize a music content, comprising:

a feature extractor to extract an audio feature value from a compressed segment of music data, from a plurality compressed segments of the music data;

a music content change detector to track change points of a music content of the music data using the extracted audio feature value and to re-configure the segments of the music data;

a clustering unit to select a fixed length fragment from each of the reconfigured segments and to cluster the selected fragments so as to measure similarity and redundancy between respective segments; and a music content summary generator to generate a summary of the music content using a segment selected based on the measured similarity and redundancy between the respective segments.

14. The system of claim 13, wherein the feature extractor performs a partial decoding process of the compressed segment of the music data so as to extract a modified discrete cosine transformation (MDCT) feature value.

15. The system of claim 13, wherein the music content change detector sets two fixed length segments based on an extracted MDCT feature value, as the extracted audio feature value, and determines a similarity between the set two fixed length segments while shifting the two fixed length segments at certain time intervals along the music data so as to detect the change points of the music content.

16. The system of claim 13, wherein the clustering unit comprises:

a first clustering unit to select the fixed length fragments from each segment by the detected change points of the music content and to perform a clustering for the selected fixed length fragments so as to measure similarity and redundancy between the respective segments by way of a Bayesian Information Criterion (BIC) operation;

a timbre and tempo feature extractor to extract MDCT-based timbre and tempo features from respective compressed segments so as to analyze corresponding music content in each segment, re-configured according to the change points of the music content;

a second clustering unit to calculate a Euclidean distance from the respective extracted timbre and tempo features to measure similarity and redundancy between the respective segments; and a decision unit to determine the similarity and redundancy between the respective segments by using a matching portion of a comparing of a result of the first clustering unit with a result of the second clustering unit, and determining a representative portion of the music data.

17. The system of claim 13, wherein the music content summary generator determines segment pairs depending on the measured similarity between the respective segments, selects first segments of the determined segment pairs as to-be-summarized targets, and generates the summary of the music content as having a constant time length while taking into consideration a ratio of the selected respective segments.

* * * * *